US008679208B2

(12) United States Patent
Can

(10) Patent No.: US 8,679,208 B2
(45) Date of Patent: Mar. 25, 2014

(54) CUBIC BORON NITRIDE COMPACT

(76) Inventor: Nedret Can, Springs (ZA)

( * ) Notice: Subject to any disclaimer, the term of this patent is extended or adjusted under 35 U.S.C. 154(b) by 572 days.

(21) Appl. No.: 12/996,743

(22) PCT Filed: Jun. 8, 2009

(86) PCT No.: PCT/IB2009/052420

§ 371 (c)(1),
(2), (4) Date: Feb. 15, 2011

(87) PCT Pub. No.: WO2009/150601

PCT Pub. Date: Dec. 17, 2009

(65) Prior Publication Data

US 2011/0138694 A1 Jun. 16, 2011

(30) Foreign Application Priority Data

Jun. 9, 2008 (GB) ..... 0810542.1

(51) Int. Cl.

| | |
|---|---|
| ***B24D 3/00*** | (2006.01) |
| ***B24D 11/00*** | (2006.01) |
| ***B24D 18/00*** | (2006.01) |
| ***C09K 3/14*** | (2006.01) |
| ***B24D 3/02*** | (2006.01) |
| ***C09C 1/68*** | (2006.01) |

(52) U.S. Cl.
USPC ..... 51/309; 513/293; 513/307

(58) Field of Classification Search
USPC ..... 51/309, 293, 307
See application file for complete search history.

(56) References Cited

U.S. PATENT DOCUMENTS

| | | | | |
|---|---|---|---|---|
| 3,918,931 | A * | 11/1975 | De Vries et al. | 51/309 |
| 4,334,928 | A * | 6/1982 | Hara et al. | 75/238 |
| 4,342,595 | A * | 8/1982 | Bourdeau | 75/238 |
| 4,693,746 | A * | 9/1987 | Nakai et al. | 75/238 |
| 2005/0129511 | A1 * | 6/2005 | Allen | 415/173.4 |
| 2006/0107602 | A1 * | 5/2006 | Sigalas et al. | 51/307 |
| 2007/0034048 | A1 * | 2/2007 | Liu | 75/236 |
| 2007/0099027 | A1 * | 5/2007 | Krishnamurthy et al. | 428/698 |

FOREIGN PATENT DOCUMENTS

| | | | |
|---|---|---|---|
| DE | 198 45 151 | A | 4/2000 |
| EP | 1 927 670 | A | 6/2008 |
| JP | 59-200733 | A | 11/1984 |
| JP | 2001-220604 | A | 8/2001 |
| WO | WO 2008/072180 | A | 6/2008 |

OTHER PUBLICATIONS

Combined Search and Examination Report dated Sep. 17, 2008, issued by the UK Intellectual Property Office for corresponding British application GB 0810542.1.

Office action issued by Japanese Patent Office for corresponding Japanese application 2011-513095, mailing date Aug. 16, 2013 with English translation.

* cited by examiner

*Primary Examiner* — James McDonough
(74) *Attorney, Agent, or Firm* — Frommer Lawrence & Haug LLP; Ronald R. Santucci

(57) ABSTRACT

The present invention relates to PCBN compacts, more specifically, to a PCBN compact comprising cBN; a secondary hard phase selected from the transition metal carbides, nitrides, carbonitrides and mixtures thereof; a superalloy bonding phase; optionally an added transition metal aluminide; and optionally a small amount of a suitable oxide, preferably, aluminum oxide or yt-trium oxide. More particularly, the cBN compact comprises 30 to 70 volume % of a polycrystalline mass of cubic boron nitride particles; 70 to 30 volume % of a matrix phase, and a superalloy. The matrix phase comprises a secondary hard phase selected from a transition metal carbide, nitride, carbonitride and a mixture thereof.

28 Claims, 1 Drawing Sheet

CUBIC BORON NITRIDE COMPACT

This application is a 371 of PCT/IB2009/052420 filed on Jun. 8, 2009, published on Dec. 17, 2009 under publication number WO 2009/150601 A and claims priority benefits of British Patent Application Number 0810542.1 filed Jun. 9, 2008, the disclosure of which is incorporated herein by reference.

BACKGROUND OF THE INVENTION

This invention relates to cubic boron nitride (cBN) abrasive compacts.

Boron nitride exists typically in three crystalline forms, namely cubic boron nitride (cBN), hexagonal boron nitride (hBN) and wurtzitic cubic boron nitride (wBN). Cubic boron nitride is a hard zinc blend form of boron nitride that has a similar structure to that of diamond. In the cBN structure, the bonds that form between the atoms are strong, mainly covalent tetrahedral bonds. cBN is the second hardest material known to man and hence is a useful industrial material.

cBN has wide commercial application in machining tools and the like. It may be used as an abrasive particle in grinding wheels, cutting tools and the like or bonded to a tool body to form a tool insert using conventional electroplating techniques.

cBN may also be used in bonded form as a cBN compact, also known as PCBN (polycrystalline cBN). cBN compacts comprise sintered masses of cBN particles. When the cBN content is at least 70 volume % of the compact, there is a considerable amount of cBN-to-cBN contact. When the cBN content is lower, e.g. in the region of 40 to 60 volume % of the compact, then the extent of direct cBN-to-cBN contact is limited.

cBN compacts will generally also contain a binder which is essentially ceramic in nature. When the cBN content of the compact is less than 70 volume %, the matrix phase, i.e. the non-cBN phase, will typically also comprise an additional or secondary hard phase, which is usually also ceramic in nature. Examples of suitable ceramic hard phases are carbides, nitrides, borides and carbonitrides of a Group 4, 5 or 6 (according to the new IUPAC format) transition metal, aluminium oxide and mixtures thereof. Other additives typically metallic or intermetallic in nature, such as Ti, Al, Ni, W, Co or a combination thereof, may be added to improve bonding between these phases. The matrix phase is defined to constitute all the ingredients in the composition excluding CBN.

cBN compacts tend to have good abrasive wear due to the inherent high hardness of cBN crystals. In addition, they are thermally stable, have a high thermal conductivity, good impact resistance and have a low coefficient of friction when in sliding contact with a workpiece. The cBN compact, with or without a substrate (the substrate having been integrally bonded to the PCBN layer during the sintering process) is often cut into the desired size and/or shape of the particular cutting or drilling tool to be used and then mounted on to a tool body utilising brazing techniques.

cBN compacts may be mechanically fixed directly to a tool body in the formation of a tool insert or tool. However, for many applications it is preferable that the compact is bonded to a substrate/support material, forming a supported compact structure, and than the supported compact structure is mechanically fixed to a tool body. The substrate/support material is typically a cemented metal carbide that is bonded together with a binder such as cobalt, nickel, iron or a mixture or alloy thereof. The metal carbide particles may comprise tungsten, titanium or tantalum carbide particles or a mixture thereof.

A known method for manufacturing the polycrystalline cBN compacts and supported compact structures involves subjecting an unsintered mass of cBN particles together with a powdered matrix phase, to high temperature and high pressure (HPHT) conditions, i.e. conditions at which the cBN is crystallographically or thermodynamically stable, for a suitable time period.

Typical conditions of high temperature and pressure which are used are temperatures in the region of 1100° C. or higher and pressures of the order of 2 GPa or higher. The time period for maintaining these conditions is typically about 3 to 120 minutes.

cBN compacts with cBN content not exceeding 70 volume % are known as low CBN PCBN materials. Typically the cBN content of such compacts lies between 30 volume % and 70 volume %. Low cBN PCBN tools with reduced thermal conductivity are best suited for finishing operations (where the depth of cut is less than 0.5 mm) and for the machining of nodular cast irons. PCBN tool performance is generally dependent on the tool geometry, as well as to machining parameters such as cutting speed, feed and depth of cut; as well as the nature of contact. Continuous cutting would imply constant contact between the tool and the workpiece for prolonged periods of time; whereas intermittent contact is generally referred to as "interrupted cutting".

The majority of machining applications contain combinations of the two types of cutting operations. In continuous cutting, temperatures at the cutting zone are much higher than in interrupted cutting, as the heat in latter can escape when the tool is not in contact with the workpiece, thus reducing overall temperatures. High temperatures result in higher "chemical wear" on the cutting tool typically identified as smooth and deep crater formation on the rake face of the tool. Therefore the main problem in continuous cutting is the deep crater formation as a result of chemical wear thereby reducing the overall strength of the cutting edge. However, in interrupted cutting operations the main problem is that the tools tend to fail catastrophically by fracturing or chipping due to cyclic impact conditions created by interrupted cutting. Cyclic mechanical, thermal stresses as well as general wear, (abrasive, adhesive and chemical) during the continuous cutting part of the interrupted cutting process lead to poor tool lives. Therefore in cutting operations that is a combination of both continuous and interrupted cutting the cutting tool edge tends to fail catastrophically by fracturing and chipping.

A conventional PCBN material design approach for manufacturing low cBN content PCBN materials has been to use metal-based starting materials such as Al, Ti and or intermetallic compounds of Ni, Ti with Al within the binder phase.

According to U.S. Pat. No. 4,334,928 at least one of the metals selected from Ni, Co, Fe and Cu can be added as a third component in the matrix to react with the cBN and secondary hard phase materials to form stable higher strength bonds. According to U.S. Pat. No. 4,693,746, the matrix phase may contain Ti-based compounds selected from the group of $TiN_z$, $Ti(C,N)_z$, $TiC_z$, $(Ti,M)C_z$, $(Ti,M)(C,N)_z$ and $(Ti,M)N_z$ (where M indicates a transition metal element of the group IVa, Va or VIa of the periodic table excepting Ti and z is within a range of about 0.7</=z</=about 0.85). The binder further contains about 20 to 30 weight % Al and about 5 to 20 weight % W. Again the aim of these further metallic species is to increase the bonding strength between matrix phase and CBN by reaction between Al, Ti and W-containing materials and cBN and forming high strength bonds.

The main drawback of these approaches is that the selection of an appropriate bonding aid material for both cBN and the secondary hard phase material is not easily achieved. This is primarily due to disparate nature of the materials involved.

For example, it is well known in the art that Al and Ti react with cBN to form reaction-bonding ceramic phases, however these metals do not easily produce high strength bonds with the secondary hard phase materials: transition metal carbides, nitrides and carbonitrides. Likewise, the addition of Ni, Co, Fe-type materials may help bonding between the secondary hard phase particles during sintering, but they do not provide for high strength bonding between cBN particles. A combined approach of using mixtures or alloys of these elements can be proposed, but this is also a sub-optimal solution because of the homogeneity constraints required in order to ensure that sufficient of each type of bonding agent is exposed to the particle type that it bonds best.

Therefore, prior art low cBN PCBN materials are typically sub-optimally bonded and hence do not perform well in demanding applications such as machining involving heavy interrupted cutting as well as the continuous cutting of hardened steels above HRc40.

SUMMARY OF THE INVENTION

According to the present invention, a cubic boron nitride compact (PCBN) comprises:

- 30 to 70 volume % of a polycrystalline mass of cubic boron nitride particles, and
- 70 to 30 volume % of a matrix phase, the matrix phase comprising:
- a secondary hard phase selected from a transition metal carbide, nitride, carbonitride and a mixture thereof, and
- a superalloy.

Typically, the superalloy, forming at least a part of a binder phase, is present in an amount of between 1 and 10 volume % of the overall matrix content, and more preferably between 1 and 5 volume %, and most preferably between 1 and 3 volume %.

According to a preferred form of the invention, the superalloy contains:

- at least 40, preferably 50, weight % of one or more of a first element selected from the group: nickel, iron and cobalt,
- two or more of a second element selected from a group of alloying elements: chromium, molybdenum, tungsten, lanthanum, cerium, yttrium, niobium, tantalum, zirconium, vanadium, hafnium, aluminium and titanium. Elements of this group will typically comprise between 5 and 60 weight % of the alloy.

The superalloy may further contain one or more of a third element selected from a second group of alloying elements: carbon, manganese, sulphur, silicon, copper, phosphorous, boron, nitrogen and tin.

In a preferred embodiment, PCBN material of the invention has a characteristic microstructure such that:

- a superalloy-based metal phase distributes itself preferentially at grain boundaries and triple points, such that a complete or partial metallic/intermetallic rim structure is often observed around cBN grains and between secondary hard phase grains;
- the metallic/intermetallic rim consists predominantly of a superalloy-based phase.

The most preferred secondary hard phase materials for the matrix are nitrides, carbides and or carbonitrides of titanium and mixtures thereof.

The cubic boron nitride content of the PCBN material of the invention comprises 30 to 70 volume % cBN, and more preferably 35 to 65 volume % cBN, and most preferably 50 to 60 volume % cBN. Typical average grain sizes for the CBN grains range from submicron to 10 micron. Coarser cBN grain sizes, optionally with multimodal size distributions, may also be used.

In a further embodiment of the invention, the matrix phase may additionally contain selected aluminides of Co, Ti, Ni, W and Cr. A preferred aluminide is $TiAl_3$. This may be directly added into CBN compact reaction mixture or may be formed in situ during pre-synthesis treatment processes through the reaction of sub-stoichiometric transition metal carbides, nitride or carbonitrides.

The PCBN compacts of the invention may further contain a small amount of oxide phase. The oxide, when present, is preferably dispersed throughout the matrix phase. It is intended to act primarily as a grain refiner for the secondary hard phase grains. Examples of suitable oxides are selected from rare earth oxides, yttrium oxide, Group 4, 5, 6-oxides, aluminium oxide, and silicon-aluminium-nitride-oxide, known as SIALON. The oxide phase is preferably finely divided and is typically present as particles that are submicron in size.

The oxide, when present, is preferably present in amount of between 1 and 2 weight % with respect to secondary hard phase content.

DETAILED DESCRIPTION

Figure 1:
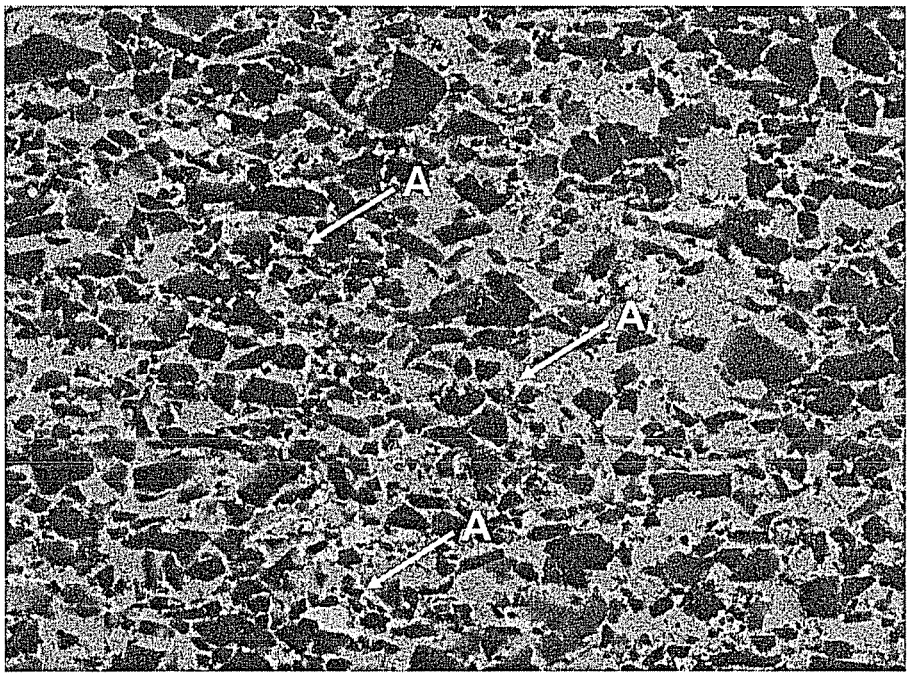
FIG. 1 is an SEM micrograph of PCBN compact of the invention.

The present invention relates to PCBN compacts, more specifically; to a PCBN compact comprising:

- cBN,
- a secondary hard phase selected from the transition metal carbides, nitrides, carbonitrides and mixtures thereof;
- a superalloy bonding phase,
- optionally an added transition metal aluminide and
- optionally a small amount of a suitable oxide, preferably, aluminium oxide or yttrium oxide.

The compact is a low cBN content PCBN material where the cBN phase is the critical component providing hardness, strength, toughness, high thermal conductivity, high abrasion resistance and low frictional coefficient in contact with iron-bearing materials. The PCBN material (cBN compact) comprises between 30 and 70 volume % cBN, more preferably 35 to 65 volume %, and most preferably 50 to 60 volume % cBN.

If the cBN content is too low, i.e. less than 30 volume %, the ceramic matrix properties tend to dominate the tool properties and hence tool life performance can be reduced significantly. If the cBN content is too high, i.e. above 70 volume %, tool life is further reduced due to exaggerated wear of the cBN phase and the resultant formation of excessively large and deep crater in the rake region of the tool, resulting in catastrophic cutting edge failure.

An essential feature of the invention is therefore the addition of a superalloy phase to the matrix phase. Superalloys are a specific class of iron, nickel, cobalt alloys that are designed for high temperature and corrosion resistant applications. They have not previously been known to be used in the matrix of low cBN content PCBN materials. This metallic binder phase comprises a metal alloy, which preferentially distributes itself around the grains of the cBN and the secondary hard phase particles, and provides high strength bonding between these particles. It appears that superalloy phases have a unique ability to effectively form high strength bonds between cBN grains, secondary hard phase particles and also between secondary hard phase and cBN particles. The superalloy is postulated to form a liquid phase during sintering that enhances the sintering process and further aids in rearrangement of secondary hard phase particles and cBN to achieve better packing.

CBN and secondary hard phase particles generally contain fairly large amount of oxides particularly on the surfaces of each particles. Normally cBN particles contain $B_2O_3$ on the surfaces of particles and secondary hard phase materials contain oxides as transition metal carboxide, nitroxide or carbonitroxide. Sometimes it is also possible to have transition metal oxide present as an impurity. The superalloy binder phase appears to be capable of reactive cleaning of these surfaces through the formation of more stable high strength oxides, which in turn behave as grain refiners for the secondary hard phase particles.

As is known in the prior art, where typical transition metal aluminides are added as a binder phase, the oxides on the surfaces of secondary hard phase and cBN will preferentially react with the metal aluminide to form stable $Al_2O_3$. As a result, the effective amount of aluminium available for bonding of cBN by reaction sintering is significantly reduced. However if metal aluminides are added together with superalloy binder phase, then alloying elements contained within the superalloy react preferentially with the impurity oxide phases to form alternative oxides and hence provide sufficient effective aluminium to bond the cBN grains. Additionally superalloy binder contains transition metals that can react and from high strength bonds with CBN especially when the alloy is in liquid form during the sintering.

In addition, superalloy binder phase wets and reacts with secondary hard phase particles forming complex phases; carbides, nitrides and carbonitrides of more than one transition metal.

The superalloy preferably contains:

at least 40 mass % of one or more of a first element selected from the group: nickel, iron and cobalt, two or more second elements selected from the alloying elements: chromium, molybdenum, tungsten, lanthanum, cerium, yttrium, niobium, tantalum, zirconium, vanadium, hafnium, aluminium and titanium.

The superalloy may further contain one or more of a third element selected from a second group of alloying elements: carbon, manganese, sulphur, silicon, copper, phosphorus, boron, nitrogen and tin.

The cBN compact of this invention may be made by adding a chosen superalloy binder in particulate form, and optionally a suitable oxide; to a typical prior-art composition comprising particulate cubic boron nitride particles and secondary hard phase particles, optionally with elements such as aluminium which reacts with cBN during sintering to form a ceramic matrix. This mixture is then subjected to elevated temperature and pressure conditions suitable to produce a compact. Typical conditions of high temperature and pressure (HPHT) which are used are temperatures in the region of 1100° C. or higher and pressures of the order of 2 GPa or higher, more preferably 4 GPa or higher. The time period for maintaining these conditions is typically about 3 to 120 minutes.

The chosen superalloy in the starting, unsintered composition may be different form the superalloy in the sintered cBN compact due, for example, to reaction of elements in the superalloy with other materials in the composition being sintered. However, the superalloy will retain its superalloy characteristics in the sintered cBN compact.

Additional metal or metal alloy may also be used to infiltrate the unbonded composition from another source during compact manufacture. The other source of metal or metal alloy will typically contain a metal such as iron, nickel or cobalt from a cemented carbide substrate on a surface of which the composition is placed prior to the application of the high temperature and pressure conditions.

The cBN compacts of this invention will typically exhibit the following characteristics due to the metallic secondary binder phase:

Metallic Rim Around Particles

It has been postulated that the metallic character of the secondary binder phase in this invention, particularly in its preferred forms, will improve the strength of the sintered PCBN compact by providing improved bonding between other particles in the composite. This is mainly due to the unique chemistries of the metallic binding phase imparted by the starting alloy, which is essentially a superalloy.

This secondary metallic binder distributes itself preferentially around cBN and around ceramic particles within the matrix, providing additional binding to the composite. The typical distribution of these binder pools within the matrix is at cBN-cBN, cBN-2° hard phase or 2° hard phase-2° hard phase grain boundaries, or at triple points (where 3 grains coincide). Due to the small amount added, this metallic phase forms a thin rim which can sometimes only be observed under very high magnifications, thus it is best observed using high resolution scanning electron microscopy. This metallic or intermetallic phase is typically derived from the composition of the starting superalloy powder and will therefore contain essentially the constituents of the superalloy, and particularly the primary constituents such as Fe, Ni and/or Co can be detected readily using Energy Dispersive Spectroscopy, X-ray fluorescence or X-ray diffraction. As the role of the superalloy additive is to chemically interact with the cBN and secondary hard phase particles, it is anticipated that the metallurgy of these metallic/intermetallic pools will typically be shifted somewhat from the original composition of the superalloy additive itself. This shift is not, however, typically so extreme that the metallic/intermetallic phase regions are no longer predominantly superalloy in composition.

Presence of Further Alloying Elements

A further preferred requirement of the binder phase metallurgy is that it contains at least second elements selected from the group: chromium, molybdenum, tungsten, lanthanum, cerium, yttrium, niobium, tantalum, zirconium, vanadium, hafnium, aluminium and titanium.

The presence of these elements can be easily identified using a suitable elemental analysis technique such as X-ray fluorescence or Energy Dispersive Spectroscopy (EDS).

The binder alloy may further contain at least one additional alloying element selected from the group: carbon, manganese, sulphur, silicon, copper, phosphorus, boron, nitrogen and tin.

Optional Presence of a Submicron Oxide

An optional requirement of the invention is to further improve the properties of the PCBN material through the addition of a suitable oxide which acts as a grain refiner in the primary phase of the matrix.

The presence of such oxides can be observed using the scanning electron microscope and detected using X-ray diffraction and/or EDS.

The cubic boron nitride compact of this invention is typically used in the finish machining of hard ferrous materials, and machining of nodular cast irons.

The invention will now be described in more detail with reference to the following non-limiting examples.

EXAMPLES

Example 1

Improved Performance of Materials of the Invention

Material A: Reference Material Using 'Prior Art' Binder

Aluminium powder having a particle size of <10 μm was added to $Ti(C_{0.5}N_{0.5})_{0.8}$ powder having an average particulate size of ~5 μm in a 10 weight % ratio. The powder mixture was turbular mixed for 1 hour using stainless steel balls, followed by a pre-reaction heat treatment at 1025° C. for 20 minutes under vacuum. The heat treated powder was subsequently crushed and sieved, followed by attrition milling in hexane using cemented carbide milling media for 4 hours. Thereafter cBN powder having an average grain size of ~1.2 μm was added to the mixture such that the volume % of the cBN was 60. The mixture was attrition milled for a further hour. The slurry was dried under vacuum and formed into a green compact supported by a cemented carbide substrate. The material was sintered at about 5.5 GPa and at about 1480° C. to produce a polycrystalline cBN compact. The cBN compact thus formed is hereinafter referred to as Material A.

Various materials were then prepared according to the invention as follows, by substituting a portion of the matrix mixture with a superalloy powder as follows.

TABLE 1

Compositions of example materials according to the invention

| Material | Aluminium (wt %) | $Ti(C_{0.5}N_{0.5})_{0.8}$ (wt %) | Superalloy (wt %) |
|---|---|---|---|
| B | 9.5 | 85.5 | 5 |
| C | 9 | 81 | 10 |
| D | 9.5 | 85.5 | 5 |

Material B:

A superalloy powder was added to the pre-reacted or heat treated primary binder powder such that it constituted 5 weight % of the overall matrix composition. The composition and manufacture of the pre-reacted binder powder was as described under Material A. The mixture is attrition milled as per Material A for 4 hours. Thereafter cBN (average grain size ~1.2 μm) was added to the slurry and the mixture was attrition milled for a further hour, as per Material A. The cBN content was kept at 60 volume %. Subsequent manufacturing steps for the final PCBN product was as per Material A. The alloy powder had an average grain size of <1 μm, and its main composition is as follows:

| Element | Ni | Co | Cr | Mo | Fe | Si |
|---|---|---|---|---|---|---|
| Mass % | 1.5 | 48 | 18 | 28 | 1.5 | 2.8 |

Figure 2:
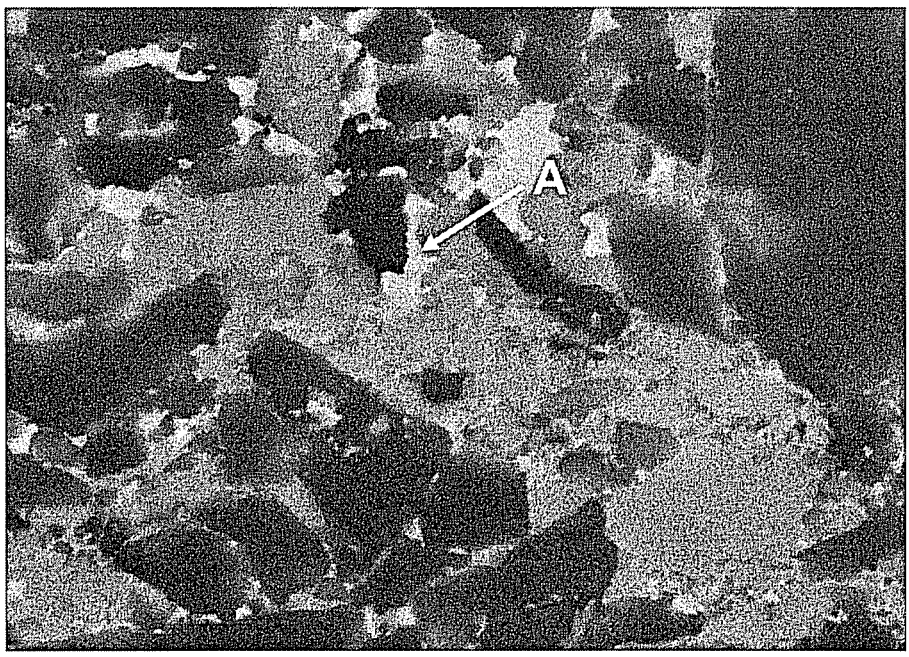
FIG. 2 is a higher magnification SEM micrograph of the same PCBN compact

Material C:

The same alloy powder as that used for material B was added to the binder such that it constituted 10 weight % of the overall matrix composition. The manufacture of this material was the same as for Material B. An SEM micrograph of the resultant microstructure for Material C is shown in FIG. 1. The cBN grains in this image are visible as very dark areas; whilst the matrix constitutes the remainder of the structure. Clearly visible are very light areas in the matrix regions, examples of which have been labelled A. These are the metallic/intermetallic rim structures characteristic of the invention. FIG. 2 is a higher magnification SEM image of the same material. The preferred distribution of the superalloy-based pools at grain boundaries between particles, or at triple points is evident.

Material D:

5 weight % of a superalloy powder (with an average particle size ~16 μm) having its main composition as shown below was added to the overall matrix, and manufactured to a cBN compact the same manner as described for Material B.

| Element | Ni | Co | Cr | Mo | Fe | Si |
|---|---|---|---|---|---|---|
| Mass % | 0.5 | 62 | 28.5 | 6 | 0.75 | 1.0 |

A sample piece was cut from each of Materials A, B, C, and D and ground to form cutting inserts. The cutting inserts were tested in an interrupted cutting test on workpiece material DIN 100Cr6. The tests were undertaken in dry machining conditions with the machining parameters as follows:

| | |
|---|---|
| Cutting speed (m/min) | 150 |
| Depth of cut (mm) | 0.2 |
| Feed (mm) | 0.1 |
| Insert geometry | SNMN 090308 T0202(check) |
| Rake angle | 75° |
| Leading angle | 15° |

The cutting inserts were tested till chipping or fracture occurred in the tool.

TABLE 2

Interrupted turning test results

| Sample | Average Number of Passes before failure |
|---|---|
| Material A (Prior Art reference) | 91 |
| Material B | 121 |
| Material C | 101 |
| Material D | 124 |

According to the results from Table 2, all the materials, viz., Materials B, C and D, which contained a secondary metallic alloy binder performed better than the reference Material A with no superalloy addition.

Effect of Superalloy Content

Comparing the results for Materials B and C in Table 1 with the same superalloy addition, but in different amounts, viz., 5 weight % and 10 weight % respectively and with respect to the overall matrix content, it is shown that a smaller addition of 5 weight % is sufficient to improve interrupted turning performance. At higher alloy content of 10 weight %, the performance of the material was inferior, although still better compared to that of the reference material, Material A, having no superalloy addition.

The invention claimed is:

1. A cubic boron nitride compact comprising:

30 to 70 volume % of a polycrystalline mass of cubic boron nitride particles, and 70 to 30 volume % of a matrix phase, the matrix phase comprising:

a secondary hard phase selected from a transition metal carbide, nitride, carbonitride and a mixture thereof, and a superalloy, wherein the matrix phase includes an aluminide of cobalt, titanium, nickel, tungsten or chromium.

2. A cubic boron nitride compact according to claim 1 wherein the aluminide is TiAl3.

3. A cubic boron nitride compact comprising:

30 to 70 volume % of a polycrystalline mass of cubic boron nitride particles, and 70 to 30 volume % of a matrix phase, the matrix phase comprising:

a secondary hard phase selected from a transition metal carbide, nitride, carbonitride and a mixture thereof, and a superalloy, wherein the matrix phase includes an oxide.

4. A cubic boron nitride according to claim 3 wherein the oxide is selected from rare earth metal oxides, yttrium oxide, Group 4,5,6-oxides, aluminium oxide, and siliconaluminium-nitride-oxide.

5. A cubic boron nitride compact according to claim 3 wherein the oxide is present in finely divided particulate form.

6. A cubic boron nitride compact according to claim 5 wherein the particles of the oxide are sub-micron particles.

7. A cubic boron nitride compact according to claim 1 wherein the polycrystalline mass of cubic boron nitride particles is present in an amount of 35 to 65 volume %.

8. A cubic boron nitride compact according to claim 1 wherein the polycrystalline mass of cubic boron nitride particles is present in an amount of 50 to 68 volume %.

9. A cubic boron nitride compact according to claim 1 wherein the superalloy is present in an amount of 1 to 10 volume % of the matrix phase.

10. A cubic boron nitride compact according to claim 1 wherein the superalloy is present in an amount of 1 to 0.5 volume % of the matrix phase.

11. A cubic boron nitride compact according to claim 1 wherein the superalloy is present in an amount of 1 to 3 volume % of the matrix phase.

12. A cubic boron nitride compact according to claim 1 wherein the superalloy contains:

at least 40 weight % of one or more of a first element selected from the group: nickel, iron and cobalt, and two or more of a second element selected from a group of alloying elements: chromium, molybdenum, tungsten, lanthanum, cerium, yttrium, niobium, tantalum, zirconium, vanadium, hafnium, aluminium and titanium.

13. A cubic boron nitride compact according to claim 12 wherein the first element is present in an amount of at least 50 weight % of the superalloy.

14. A cubic boron nitride compact according to claim 12 wherein the second elements are present in amount of 5 to 60 weight % of the superalloy.

15. A cubic boron nitride compact according to claim 12 wherein the superalloy contains a third element selected from the group of carbon, manganese, sulphur, silicon, copper, phosphorus, boron, nitrogen and tin.

16. A cubic boron nitride compact according to claim 12 wherein a superalloy is distributed at grain boundaries and triple points in the polycrystalline mass of cubic boron nitride particles such that a metallic/intermetallic rim structure is present around at least some of the cubic boron nitride grains and/or between at least some of the grains of secondary hard phase.

17. A cubic boron nitride compact according to claim 16 wherein the metallic/intermetallic rim consists predominantly of a superalloy.

18. A cubic boron nitride compact according to claim 3 wherein the polycrystalline mass of cubic boron nitride particles is present in an amount of 35 to 65 volume %.

19. A cubic boron nitride compact according to claim 3 wherein the polycrystalline mass of cubic boron nitride particles is present in an amount of 50 to 60 volume %.

20. A cubic boron nitride compact according to claim 3 wherein the superalloy is present in an amount of 1 to 10 volume % of the matrix phase.

21. A cubic boron nitride compact according to claim 3 wherein the superalloy is present in an amount of 1 to 5 volume % of the matrix phase.

22. A cubic boron nitride compact according to claim 3 wherein the superalloy is present in an amount of 1 to 3 volume % of the matrix phase.

23. A cubic boron nitride compact according to claim 3 wherein the superalloy contains:

at east 40 weight % of one or more of a first element selected from the group: nickel, iron and cobalt, and two or more of a second element selected from a group of alloying elements: chromium, molybdenum, tungsten, lanthanum, cerium, yttrium, niobium, tantalum, zirconium, vanadium, hafnium, aluminium and titanium.

24. A cubic boron nitride compact according to claim 23 wherein the first element is present in an amount of at least 50 weight % of the superalloy.

25. A cubic boron nitride compact according to claim 23 wherein the second elements are present in amount of 5 to 60 weight % of the superalloy.

26. A cubic boron nitride compact according to claim 23 wherein the superalloy contains a third element selected from the group of carbon, manganese, sulphur, silicon, copper, phosphorus, boron, nitrogen and tin.

27. A cubic boron nitride compact according to claim 23 wherein a superalloy is distributed at grain boundaries and triple points in the polycrystalline mass of cubic boron nitride particles such that a metallic/intermetallic rim structure is present around at least some of the cubic boron nitride grains and/or between at least some of the grains of secondary hard phase.

28. A cubic boron nitride compact according to claim 27 wherein the metallic/intermetallic rim consists predominantly of a superalloy.

* * * * *